US005630456A

United States Patent [19]

Hugo et al.

[11] Patent Number: 5,630,456

[45] Date of Patent: May 20, 1997

[54] WINDOW BLIND CORD WINDING APPARATUS

[76] Inventors: Marie J. R. Hugo; Ross Hugo, both of R.R. #2, New Sarepta, Alberta, Canada, T0B 3M0

[21] Appl. No.: 646,385

[22] Filed: May 8, 1996

[51] Int. Cl.[6] ..... E06B 9/30

[52] U.S. Cl. ..... 160/173; 160/178.1; 242/388; 242/395; 242/396.4

[58] Field of Search ..... 160/173 R, 168.1 R, 160/320, 321, 178.1 R, 178.2 R, 107; 242/395, 395.1, 396.4, 388

[56] References Cited

U.S. PATENT DOCUMENTS

| | | | |
|---|---|---|---|
| 967,601 | 8/1910 | Bovard | 242/396.4 X |
| 1,027,655 | 5/1912 | Johnson | 242/396.4 X |
| 1,089,023 | 3/1914 | Trautner | 242/396.4 X |
| 2,187,458 | 1/1940 | Lawson | 242/395 X |
| 3,044,732 | 7/1962 | Simonds | 242/395.1 |
| 3,123,130 | 3/1964 | Fridlund | 160/168.1 R |
| 3,465,806 | 9/1969 | Sulkes | 160/84.06 |
| 4,271,893 | 6/1981 | McCluskey | 160/178.1 R |
| 5,279,473 | 1/1994 | Rozon | 160/178.1 R X |

FOREIGN PATENT DOCUMENTS

| | | | |
|---|---|---|---|
| 2095165 | 4/1993 | Canada | E06B 9/322 |

*Primary Examiner*—David M. Purol

*Attorney, Agent, or Firm*—Anthony R. Lambert

[57] ABSTRACT

A window blind cord winding apparatus includes an outer housing with a circular spool receiving cavity. A spool is provided that has a circular cord bell receiving cavity. The spool is disposed within the circular spool receiving cavity of the outer housing. The circular cord bell receiving cavity has an inner surface with a gear profile. A closure cap is engagable with the outer sidewall to enclose the outer housing. The closure cap has an exterior surface and an interior cavity. A shaft extends through the closure cap. The shaft has a first end extending into the interior cavity and a second end extending from the exterior surface. A gear is mounted to the first end of the shaft. A hand grip is secured to the second end of the shaft. When the closure cap is placed onto the outer housing the gear engages the gear profile on the inner surface of the cord bell receiving cavity of the spool. Upon the hand grip being used to rotate the shaft, the gear rotates engaging the gear profile to rotate the spool. A locking mechanism is provided for locking the spool in a selected rotational position relative to the outer housing.

3 Claims, 3 Drawing Sheets

WINDOW BLIND CORD WINDING APPARATUS

FIELD OF THE INVENTION

The present invention relates to a window blind cord winding apparatus

BACKGROUND OF THE INVENTION

A window blind cord presents a potential hazard to infants. An infant is attracted to a dangling window blind cord. The dangling cord swings back and forth, providing a source of interest and amusement. In the process of playing with the cord, however, the infant can be tangled in the cord. Infants have been injured when they fell with the cord wrapped around them. If the cord is wrapped around a sensitive area, such as the infant's neck, the injury can be fatal.

In order to reduce or eliminate the danger to infants window blind cord winding apparatus have been developed. An example of such a window blind cord winding apparatus is Canadian Patent Application 2,095,165 by Rozon published in 1993. The Rozon apparatus discloses a spool assembly which is capped by a retainer plate that extends across one face. This retainer serves to retain cord on the spool. The retainer is rotatable between a first or access position and a second or use position. In the access position a user is selectively provided with access to the interior of the spool through an elbow shaped opening. A pair of grip openings are provided. The user inserts his fingers into the grip openings in order to rotate the retainer to the access position. In order to attach the apparatus to a window blind having free cord ends, the cord bells at the free ends of the cord are removed. The cord ends are then threaded through a slot into the interior of the spool. The user then turns the retainer to the access position and ties the two free ends of the cord to form a knot that is large enough that it resists the free ends of the cord being pulled through the slot. This mode of assembly is not very convenient for the user. Furthermore, if the knot is not a sufficient size, the knot will be pulled from the interior of the spool during use. The Rozon reference does contemplate use with a single window blind cord.

SUMMARY OF THE INVENTION

What is required is a window blind cord winding apparatus that is easier to use and can be used with a single window blind cord.

According to the present invention there is provided a window blind cord winding apparatus that includes an outer housing including a base plate and an outer sidewall that extends from the base plate to define a circular spool receiving cavity. A slot is provided through the outer sidewall, thereby providing access to the circular spool receiving cavity. A spool is provided including a circular base plate and a sidewall that extends from the base plate to define a circular cord bell receiving cavity. The spool is rotatably mounted within the circular spool receiving cavity of the outer housing. A slot is provided through the sidewall thereby permitting access to the circular cord bell receiving cavity. The circular cord bell receiving cavity has an inner surface with a gear profile. A closure cap is engagable with the outer sidewall to enclose the outer housing. The closure cap has an exterior surface and an interior cavity. A shaft extends through the closure cap. The shaft has a first end extending into the interior cavity and a second end extending from the exterior surface. A gear is rotatably mounted to the first end of the shaft. A hand grip is secured to the second end of the shaft. When the closure cap is placed onto the outer housing the gear engages the gear profile on the inner surface of the cord bell receiving cavity of the spool. Upon the hand grip being used to rotate the shaft, the gear rotates engaging the gear profile to rotate the spool. Means is provided for locking the spool in a selected rotational position relative to the housing.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
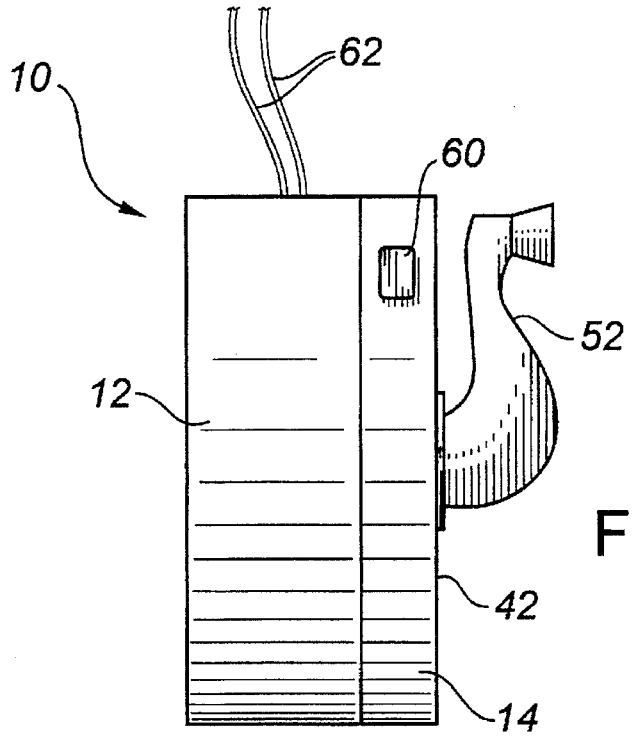
FIG. 1 is a side elevation view of a window blind cord winding apparatus constructed in accordance with the teachings of the present invention.

The preferred embodiment, a window blind cord winding apparatus generally identified by reference numeral 10, will now be described with reference to FIGS. 1 through 5.

Figure 2:
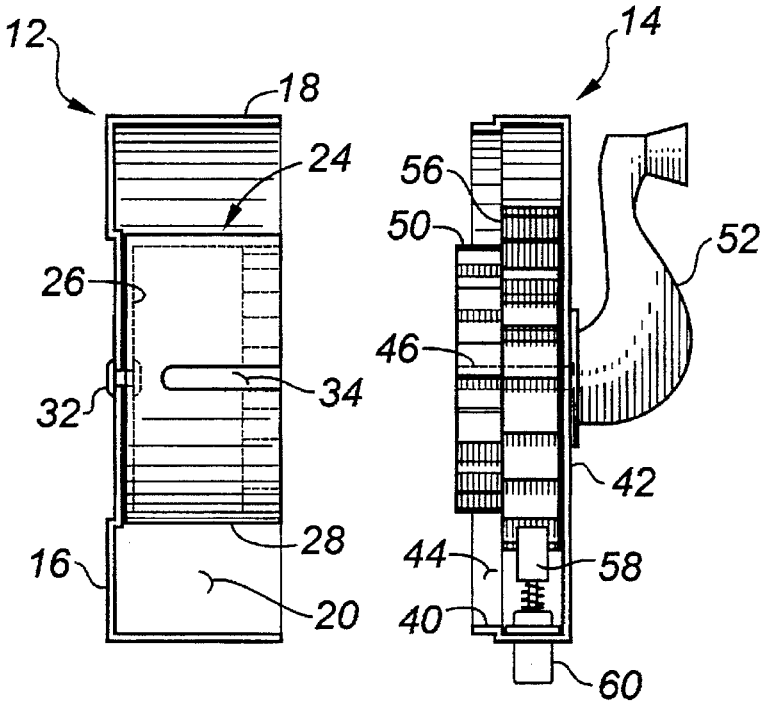
FIG. 2 is an exploded side elevation view, in section, of the window blind cord winding apparatus illustrated in FIG. 1.
Figure 3:
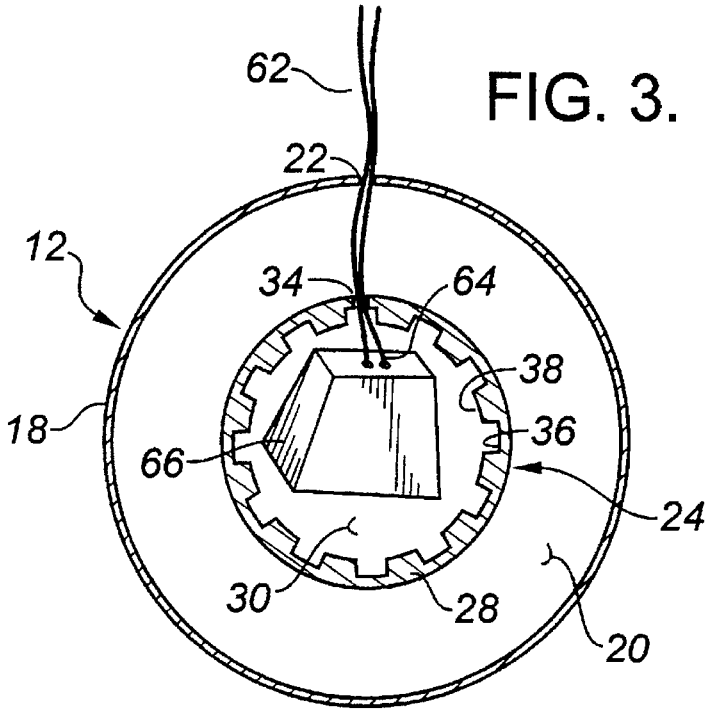
FIG. 3 is a right end elevation view, in section, of the window blind cord winding apparatus illustrated in FIG. 1.
Figure 4:
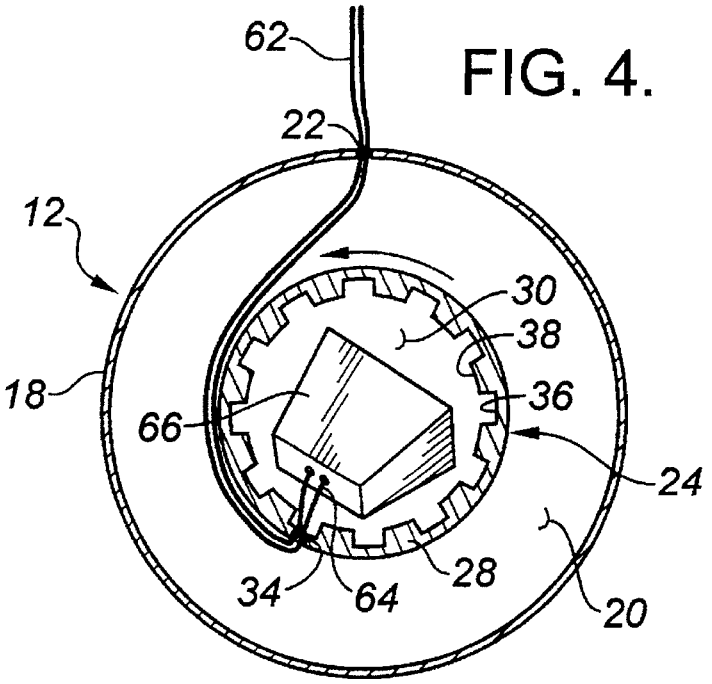
FIG. 4 is a right end elevation view, in section, of the window blind cord winding apparatus illustrated in FIG. 1.
Figure 5:
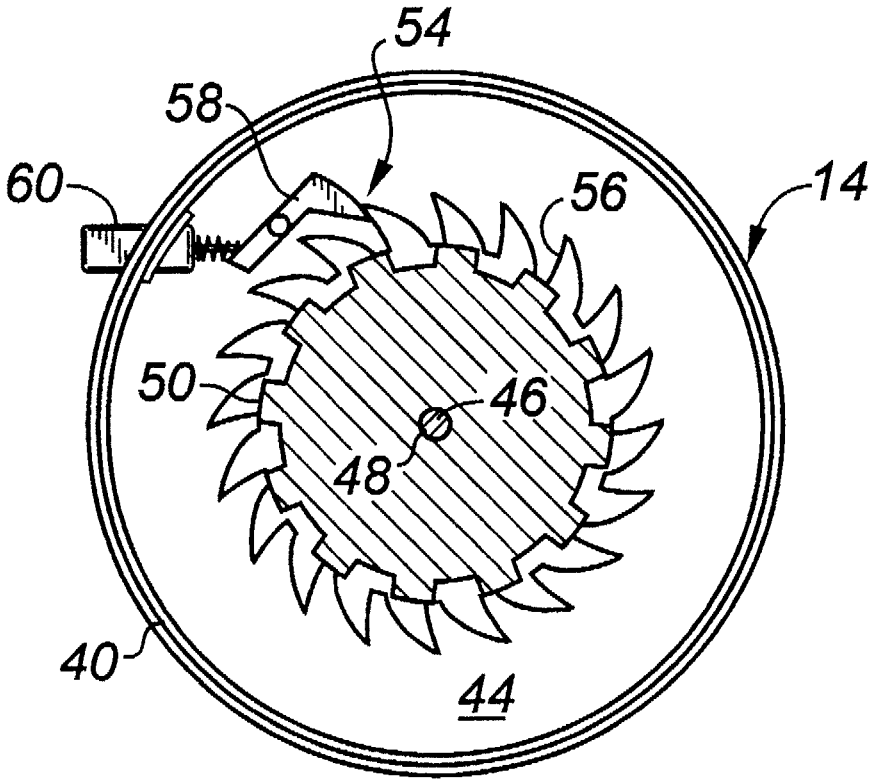
FIG. 5 is a left end elevation view, in section, of the window blind cord winding apparatus illustrated in FIG. 1.

Referring to FIG. 1, window blind cord winding apparatus 10 includes an outer housing 12 and a closure cap 14. Referring to FIGS. 2 through 4, outer housing 12 includes a base plate 16 and an outer sidewall 18 that extends from base plate 16 to define a circular spool receiving cavity 20. A cord access slot 22 is provided through outer sidewall 18 to provide access to circular spool receiving cavity 20. A spool 24 is provided including a circular base plate 26 and a sidewall 28 that extends from base plate 26 to define a circular cord bell receiving cavity 30. Referring to FIG. 2, spool 24 is rotatably mounted by means of a rivet 32 within circular spool receiving cavity 20 of outer housing 12. A cord access slot 34 is provided through sidewall 28 thereby providing access to circular cord bell receiving cavity 30. Referring to FIGS. 3 and 4, circular cord bell receiving cavity 30 has an inner surface 36 with a gear profile 38. Referring to FIG. 2, closure cap 14 has an annular clamping flange 40. When closure cap 14 is placed onto outer housing 12, annular clamping flange 40 engages outer sidewall 18 to enclose outer housing 12. Referring to FIG. 2, closure cap 14 has an exterior surface 42 and an interior cavity 44. Referring to FIG. 5, a shaft 46 extends through closure cap 14. Shaft 46 has a first end 48 and a second end (not shown). First end 48 extends into interior cavity 44 and is secured to a gear 50. Referring to FIG. 2, the second end (not shown) extends from exterior surface 42 and is attached to a crank 52 that provides a hand grip for manipulation of shaft 46. When closure cap 14 is placed onto outer housing 12 gear 50 engages gear profile 38 on inner surface 36 of bell receiving cavity 30 of spool 24. Referring to FIG. 5, a ratchet mechanism 54 is used as means for locking spool 24 in a selected rotational position relative to outer housing 12. Ratchet mechanism 54 includes a ratchet gear profile 56 which mates with a gear member 58 that is pivotally mounted within interior cavity 44 of closure cap 14. Gear member 58 is pivotally movable between a locking position engaging ratchet gear profile 56 and a release position spaced from ratchet gear profile 56. A release button 60 extends through closure cap 14. Release button 60 is accessible from exterior surface 42. When pressed it engages gear member 58 to pivot gear member 58 to the release position.

The use and operation of window blind cord winding apparatus 10 will now be described with reference to FIGS. 1 through 5. Referring to FIG. 2, closure cap 14 is removed to provide access to cord bell receiving cavity 30 of spool 24. Referring to FIGS. 3 and 4, window blind cords 62 have a free end 64 on which is positioned a cord bell 66. Cord bell 66 is positioned in circular cord bell receiving cavity 30. Cord 62 is then extended through slot 34 in spool 24 and slot 22 in outer housing 12. Closure cap 14 is then repositioned onto outer housing 12. When closure cap 14 is placed onto outer housing 12 gear 50 engages gear profile 38 on inner surface 36 of bell receiving cavity 30 of spool 24. Upon crank 52 being rotated, gear 50 rotates engaging gear profile 38 to rotate spool 24. This winds cord 62 around spool 24 in the manner illustrated in FIG. 4. Ratchet mechanism 54 maintains spool 24 in the selected rotational position. Ratchet mechanism 54 permits rotation of spool 24 is only one direction, namely, to wind more of cord 62 onto spool 24. When it is desired to release some cord, button 60 must be pushed to pivot gear member 58 to the release position in which spool 24 is free to rotate in the opposite direction.

It will be apparent to one skilled in the art the relative simplicity and ease of use provided by window blind cord winding apparatus 10. In addition, in order to use apparatus 10, the user need not temporarily remove, and thus risk losing the cord bells from their blinds. It will also be apparent to one skilled in that art that a dial, knob or the like could be substituted for crank 52. It will finally be apparent to one skilled in the art that other modifications may be made to the illustrated embodiment without departing from the spirit and scope of the invention as hereinafter defined in the Claims.

The embodiments of the invention in which an exclusive property or privilege is claimed are defined as follows:

1. A window blind cord winding apparatus, comprising:

an outer housing having a circular spool receiving cavity with a cord access opening;

a spool positioned in the spool receiving cavity of the outer housing, the spool having a circular cord bell receiving cavity with an inner gear profile and a cord access opening;

a removable closure cap engagable with the outer housing, the closure cap having an exterior surface and an interior cavity, a shaft extending through the closure cap, the shaft having a first end extending into the interior cavity and a second end extending from the exterior surface, a gear being mounted to the first end of the shaft, a hand grip being secured to the second end of the shaft, the gear engaging the inner gear profile on the cord bell receiving cavity of the spool, whereby the hand grip is used to rotate the gear with the gear engaging the inner gear profile to rotate the spool; and means for locking the spool in a selected rotational position relative to the outer housing.

2. A window blind cord winding apparatus, comprising:

an outer housing including a base plate and an outer sidewall that extends from the base plate to define a circular spool receiving cavity, a slot being provided through the outer sidewall, thereby providing access to the circular spool receiving cavity;

a spool including a circular base plate and a sidewall that extends from the base plate to define a circular cord bell receiving cavity, the spool being rotatably mounted within the circular spool receiving cavity of the outer housing, a slot being provided through the sidewall thereby providing access to the circular cord bell receiving cavity, the circular cord bell receiving cavity having an inner surface with a gear profile;

a closure cap engagable with the outer sidewall to enclose the outer housing, the closure cap having an exterior surface and an interior cavity, a shaft extending through the closure cap, the shaft having a first end extending into the interior cavity and a second end extending from the exterior surface, a gear being mounted to the first end of the shaft, a hand grip being secured to the second end of the shaft, when the closure cap is placed onto the outer housing the gear engages the gear profile on the inner surface of the cord bell receiving cavity of the spool, such that upon the hand grip being used to rotate the shaft, the gear rotates engaging the gear profile to rotate the spool; and means for locking the spool in a selected rotational position relative to the outer housing.

3. In combination;

a window blind cord having a free end on which is positioned a cord bell;

a window blind cord winding apparatus, including:

an outer housing including a base plate and an outer sidewall that extends from the base plate to define a circular spool receiving cavity, a slot being provided through the outer sidewall, thereby providing access to the circular spool receiving cavity;

a spool including a circular base plate and a sidewall that extends from the base plate to define a circular cord bell receiving cavity, the spool being rotatably mounted within the circular spool receiving cavity of the outer housing, a slot being provided through the sidewall thereby providing access to the circular cord bell receiving cavity, the circular cord bell receiving cavity having an inner surface with a gear profile; and a closure cap engagable with the outer sidewall to enclose the outer housing, the closure cap having an exterior surface and an interior cavity, a shaft extending through the closure cap, the shaft having a first end extending into the interior cavity and a second end extending from the exterior surface, a gear being mounted to the first end of the shaft, a hand grip being secured to the second end of the shaft, when the closure cap is placed onto the outer housing the gear engages the gear profile on the inner surface of the bell receiving cavity of the spool; and means for locking the spool in a selected rotational position relative to the outer housing;

the cord bell being positioned in the circular cord bell receiving cavity, the cord being extended through the slot in the spool and the slot in the outer housing, such that upon the hand grip being used to rotate the shaft, the gear rotates engaging the gear profile to rotate the spool, thereby winding the cord around the spool.

* * * * *